US009617794B2

(12) United States Patent
Durairajan et al.

(10) Patent No.: US 9,617,794 B2
(45) Date of Patent: Apr. 11, 2017

(54) FEATURE TO ELIMINATE SHALE PACKING/SHALE EVACUATION CHANNEL

(75) Inventors: Bala Durairajan, Houston, TX (US); Rahul Bijai, Spring, TX (US); Sandeep Tammineni, Houston, TX (US); William Moore, Ponca City, OK (US); Ehren Long, Ponca City, OK (US)

(73) Assignee: SMITH INTERNATIONAL, INC., Houston, TX (US)

( * ) Notice: Subject to any disclaimer, the term of this patent is extended or adjusted under 35 U.S.C. 154(b) by 772 days.

(21) Appl. No.: 13/531,007

(22) Filed: Jun. 22, 2012

(65) Prior Publication Data

US 2013/0341101 A1 Dec. 26, 2013

(51) Int. Cl.
*E21B 10/60* (2006.01)
*E21B 10/43* (2006.01)

(52) U.S. Cl.
CPC ..... *E21B 10/602* (2013.01); *E21B 10/43* (2013.01)

(58) Field of Classification Search
CPC ... E21B 10/602; E21B 2010/607; E21B 10/61
See application file for complete search history.

(56) References Cited

U.S. PATENT DOCUMENTS 2,607,562 A * 8/1952 Phipps ..... E21B 10/26 175/391
4,535,853 A 8/1985 Ippolito et al.
5,025,875 A 6/1991 Witt
5,363,932 A * 11/1994 Azar ..... E21B 10/602 175/417
5,641,028 A 6/1997 Resendez et al.
5,669,459 A 9/1997 Larsen et al.
5,671,818 A 9/1997 Newton et al.
5,941,461 A * 8/1999 Akin et al. ..... 239/428.5
6,079,507 A * 6/2000 Trujillo ..... E21B 10/18 175/339
6,264,367 B1 7/2001 Slaughter, Jr. et al.
6,302,223 B1 10/2001 Sinor
D519,533 S 4/2006 Frey
(Continued)

OTHER PUBLICATIONS

"New Roller Cone Bits With Unique Nozzle Designs Reduce Drilling Costs"; Moffitt, S.R., Pearce, D.E., Ivie, C.R., Reed Tool Co.; SPE/IADC Drilling Conference Feb. 18-21, 1992, New Orleans, Louisiana (10 pages).
(Continued)

*Primary Examiner* — David Andrews

(57) ABSTRACT

A drill bit having a bit body with a longitudinal axis extending therethrough and a plurality of blades extending from the bit body is disclosed. Each blade has an outer face and at least one side wall. The drill bit has at least one junk slot, wherein each junk slot is defined by the bit body surface and the side walls of adjacent blades. At least one nozzle bore is formed in the bit body, wherein each nozzle bore has an intersecting surface between the bit body surface of a junk slot and an inner surface of the nozzle bore. At least one formation evacuation channel extends through the intersecting surface of at least one of the nozzle bores, wherein each formation evacuation channel has a base surface, and wherein the formation evacuation channel extends partially around the circumference of the nozzle bore.

29 Claims, 19 Drawing Sheets

(56) References Cited

U.S. PATENT DOCUMENTS

| | | | | |
|---|---|---|---|---|
| 7,040,423 | B2 | 5/2006 | Larsen et al. | |
| D526,669 | S | 8/2006 | McCoppin | |
| 7,325,631 | B2 | 2/2008 | Roberts et al. | |
| D602,055 | S | 10/2009 | Yanagida et al. | |
| 7,886,851 | B2 | 2/2011 | Hall et al. | |
| 8,020,639 | B2 | 9/2011 | Wells et al. | |
| D647,115 | S | 10/2011 | Pearce et al. | |
| D649,988 | S | 12/2011 | Frejd | |
| 2008/0164071 | A1 | 7/2008 | Patel et al. | |
| 2010/0230175 | A1 | 9/2010 | Engstrom | |
| 2010/0270081 | A1 | 10/2010 | Perry, Jr. et al. | |
| 2011/0073377 | A1* | 3/2011 | Rickabaugh et al. | 175/393 |
| 2011/0284293 | A1 | 11/2011 | Shen et al. | |

OTHER PUBLICATIONS

"Hole Cleaning Performance of Light-Weight Drilling Fluids During Horizontal Underbalanced Drilling"; M.E. Ozbayoglu, M. Sorgun, Middle East Technical University, Ankara, Turkey; A. Saasen, University of Stavanger, Stavanger, Norway, and Statoil Hydro; K. Svanes, Statoil Hydro, Stavanger, Norway Journal of Canadian Petroleum Technology, vol. 49, No. 4, Apr. 2010 pp. 21-26 (6 pages).

* cited by examiner

FEATURE TO ELIMINATE SHALE PACKING/SHALE EVACUATION CHANNEL

BACKGROUND

Field

Embodiments disclosed herein generally relate to fixed cutter cutting tools having improved formation evacuation elements.

Background Art

In drilling a borehole in the earth, such as for the recovery of hydrocarbons or for other applications, it is conventional practice to connect a drill bit on the lower end of an assembly of drill pipe sections that are connected end-to-end so as to form a "drill string." The bit is rotated by rotating the drill string at the surface or by actuation of downhole motors or turbines, or by both methods. With weight applied to the drill string, the rotating bit engages the earthen formation causing the bit to cut through the formation material by either abrasion, fracturing, or shearing action, or through a combination of all cutting methods, thereby forming a borehole along a predetermined path toward a target zone.

Many different types of drill bits have been developed and found useful in drilling such boreholes. Two predominate types of drill bits are roller cone bits and fixed cutter (or rotary drag) bits. Most fixed cutter bit designs include a plurality of blades angularly spaced about the bit face. The blades project radially outward from the bit body and form flow channels, or junk slots, therebetween. In addition, cutting elements are typically grouped and mounted on several blades in radially extending rows. The configuration or layout of the cutting elements on the blades may vary widely, depending on a number of factors such as the formation to be drilled.

A conventional drag bit is shown in FIG. 1. The drill bit 10 includes a bit body 12 and a plurality of blades 14 extending radially from the bit body 12. The blades 14 are separated by channels or junk slots 16 that enable drilling fluid to flow between and both clean and cool the blades 14 and cutters 18. Cutters 18 are held in the blades 14 at predetermined angular orientations and radial locations to present working surfaces 20 with a desired back rake angle against a formation to be drilled. Typically, the working surfaces 20 are generally perpendicular to the axis 19 and side surface 21 of a cylindrical cutter 18. Thus, the working surface 20 and the side surface 21 meet or intersect to form a circumferential cutting edge 22.

Orifices are typically formed in the drill bit body 12 and positioned in the junk slots 16. The orifices are commonly adapted to accept nozzles 23, wherein the orifices may also be referred to as nozzle bores. The orifices allow drilling fluid to be discharged through the bit in selected directions and at selected rates of flow between the cutting blades 14 for lubricating and cooling the drill bit 10, the blades 14 and the cutters 18. The drilling fluid also cleans and removes the cuttings as the drill bit rotates and penetrates the geological formation. Without proper flow characteristics, insufficient cooling of the cutters may result in cutter failure during drilling operates. The junk slots 16, which may also be referred to as "fluid courses," are positioned to provide additional flow channels for drilling fluid and to provide a passage for formation cuttings to travel past the drill bit 10 toward the surface of a wellbore (not shown).

The drill bit 10 includes a shank 24 and a crown 26. The shank 24 is typically formed of steel or a matrix material and includes a threaded pin 28 for attachment to a drill string.

The crown 26 has a cutting face 30 and outer side surface 32. The particular materials used to form drill bit bodies are selected to provide adequate strength and toughness, while providing good resistance to abrasive and erosive wear.

The combined plurality of surfaces 20 of the cutters 18 effectively forms the cutting face 30 of the drill bit 10. Once the crown 26 is formed, the cutters 18 are positioned in the cutter pockets 34 and affixed by any suitable method, such as brazing, adhesive, mechanical means such as interference fit, or the like. The design depicted provides the cutter pockets 34 inclined with respect to the surface of the crown 26. The cutter pockets 34 are inclined such that cutters 18 are oriented with the working face 20 at a desired rake angle in the direction of rotation of the bit 10 so as to enhance cutting. It will be understood that in an alternative construction (not shown), the cutters can each be substantially perpendicular to the surface of the crown, while an ultra-hard surface is affixed to a substrate at an angle on a cutter body or a stud so that a desired rake angle is achieved at the working surface.

During drilling operations, a drag bit may shear the formation being drilled, thereby generating formation cuttings. Such cuttings often become trapped and accumulate within select regions of the drill bit, such as within the bit junk slots. Accumulated cuttings may interfere with fluid flow through the bit junk slots and eventually lead to bit balling. When drilling operations are conducted in formations containing shale, accumulated cuttings may be referred to as shale-packing. There have been various attempts at reducing accumulation of cuttings, such as designing particular placement of fluid nozzles or drag bit blade shapes. However, a need still exists for reduced cuttings accumulation and shale packing.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments of the present disclosure relate to a drill bit having a bit body with a longitudinal axis extending therethrough, a plurality of blades extending from the bit body, wherein each blade has an outer face and at least one side wall, at least one junk slot, wherein each junk slot is defined by the bit body surface and the side walls of adjacent blades, at least one nozzle bore formed in the bit body having an intersecting surface between the bit body surface of a junk slot and an inner surface of the nozzle bore, and at least one formation evacuation channel extending through the intersecting surface of at least one of the nozzle bores, wherein each formation evacuation channel has a base surface and wherein the formation evacuation channel extends partially around the circumference of the nozzle bore.

Other aspects and advantages of the invention will be apparent from the following description and the appended claims.

DETAILED DESCRIPTION

In one aspect, embodiments disclosed herein relate to downhole drill bits having one or more elements for improved cuttings evacuation. Such elements may include at least one of a formation evacuation channel and/or a high sloping body, described below. The evacuation elements may be particularly useful for drilling shale formations.

Figure 1:
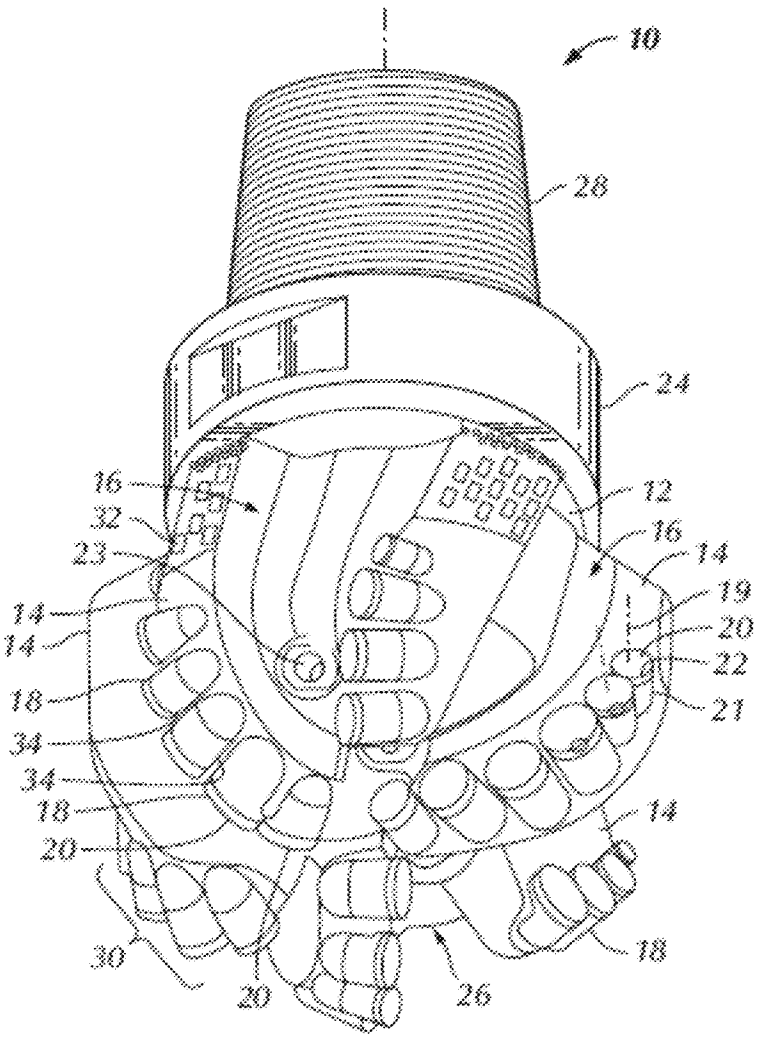
FIG. 1 (Prior Art)
FIG. 1 shows a conventional drag bit.
Figure 2:
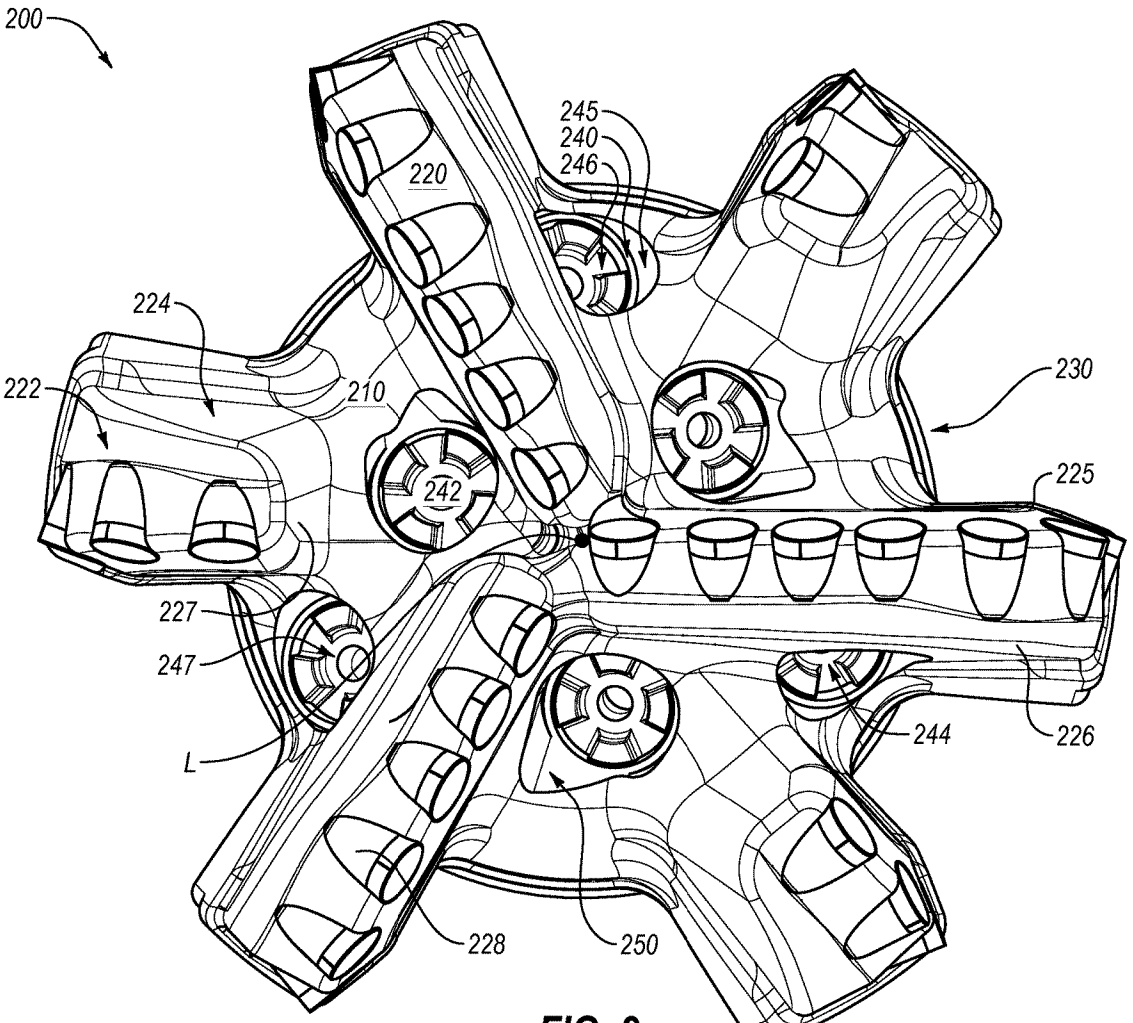
FIG. 2 shows a top view of a drill bit according to embodiments of the present disclosure.
Figure 3:
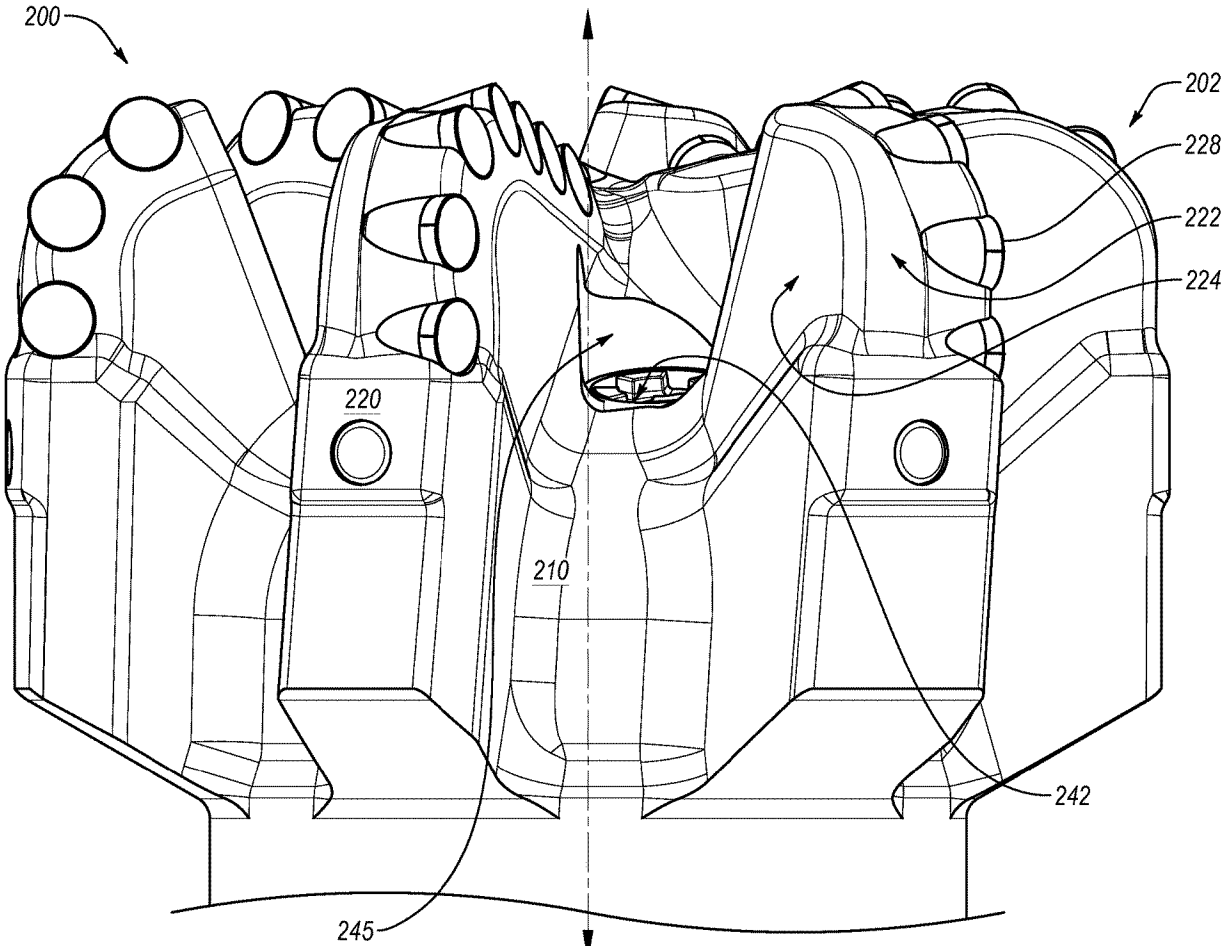
FIG. 3 shows a side view of a drill bit according to embodiments of the present disclosure.

FIGS. 2 and 3 show a top view and side view, respectively, of a drill bit 200 according to embodiments of the present disclosure. The drill bit 200 has a bit body 210 with a longitudinal axis L extending therethrough. A plurality of blades 220 extends from the bit body 210, radially from the bit body surface and axially along the bit body surface from a bit cutting face 202 to a bit connection end (not shown). Each blade 220 has an outer face 222 and at least one side wall 224. As shown, the side walls 224 of the blades 220 extend a height from the bit body surface to the blade outer face 222. Blade side walls may have a sloped or curved transition into the blade outer face. Alternatively, a blade side wall may intersect the blade outer face substantially perpendicularly. Furthermore, side walls that face in the rotational direction of the bit may often be referred to as the blade leading face 225, while side walls that face opposite the rotational direction of the bit may often be referred to as a trailing face 226. Additionally, a blade side wall may face other directions, such as toward the center of the bit, or longitudinal axis L, at the bit cutting face, represented by 227. Cutting elements known in the art may be disposed on the plurality of blades at the blade leading face. For example, a plurality of polycrystalline diamond compact ("PDC") cutters 228 (i.e., cutting elements having a PDC table forming a cutting face mounted to a substrate, as known in the art) may be disposed along a blade leading face, wherein the cutting faces of the PDC cutters face in the direction of the bit's rotation. Thus, as the bit rotates, the cutting faces of the PDC cutters may contact and cut the earthen formation to be drilled.

The drill bit also has at least one junk slot 230, wherein each junk slot 230 is defined by the bit body surface 210 and the side walls 224 of adjacent blades 220. In effect, the junk slots 230 form passages or channels between the blades 220 that may be used to direct drilling fluids and any cuttings from drilling an earthen formation between the blades and up the wellbore. For example, drilling fluid may be directed through the junk slots to evacuate the cuttings from drilling and to cool the bit cutting elements.

Additionally, at least one nozzle bore 240 is formed in the bit body 210, within a junk slot area 230. Each nozzle bore 240 has an intersecting surface 245 formed between the bit body surface 210 of a junk slot 230 and an inner surface of the nozzle bore 240, wherein the intersecting surface 245 is defined by the bit body shape and nozzle bore, size and orientation. For example, during manufacture of the drill bit, a hole may be formed through the bit body surface of a junk slot to form a nozzle bore. The bit body material remaining at the bit body surface that outlines the nozzle bore may be referred to as the "intersecting surface" of the nozzle bore, or a ledge. As used herein, the term "ledge" refers to the intersecting surface defining a nozzle bore, wherein the surface forms an angle with the bit body surface. Further, the intersecting surface between the bit body surface and inner surface of the nozzle bore may be a radiused transition. For example, an inner surface of a nozzle bore may transition to the surrounding bit body surface, such as by a curved surface or one or more angled surfaces, e.g., a bevel or chamfer All or part of the intersecting surface between the bit body surface and inner surface of a nozzle bore may form a radiused transition.

According to some embodiments, the intersecting surface may extend an angle less than 120° from the bit body surface. In embodiments having a nozzle disposed within the nozzle bore (described below), the intersecting surface may extend greater than 60° from the nozzle face to the bit body surface. According to embodiments of the present disclosure, a nozzle or port may be disposed in a nozzle bore.

Nozzle bores 240 may be formed at various locations on the bit. For example, nozzle bores 240 may be formed proximate to the radial center of the bit cutting end, as shown by nozzle bore 242 in FIGS. 2 and 3. Other nozzle bores may be formed, for example, distant from the radial center of the cutting end, such as shown by nozzle bore 244 in FIG. 2. Further, nozzle bores may be formed proximate to an adjacent blade, distant from an adjacent blade, and/or equidistant between adjacent blades. Additionally, as shown in FIG. 2, a nozzle 246 may be disposed within a nozzle bore 240, wherein the nozzle has a nozzle face 247 exposed within the nozzle bore 240. The nozzle 246 may be used to direct drilling fluid through the junk slots 230.

The positions of nozzles and nozzle bores may be designed to optimize the flow of cuttings and/or drilling fluids through the blades and away from the bit. For example, as stated above, nozzle bores may be disposed at various locations within the junk slot areas. As another example, nozzles may be oriented in particular directions such that the nozzle faces form selected angles with respect to the immediately surrounding bit body surface. Methods of optimizing nozzle position and placement are known in the art, such as found in U.S. Patent Publication No. 2006/0076163, which describes achieving uniform fluid flow from nozzles through junk slots by, in part, modifying the radial locations, nozzle seat depth, nozzle skew and profile angles.

Figure 4:
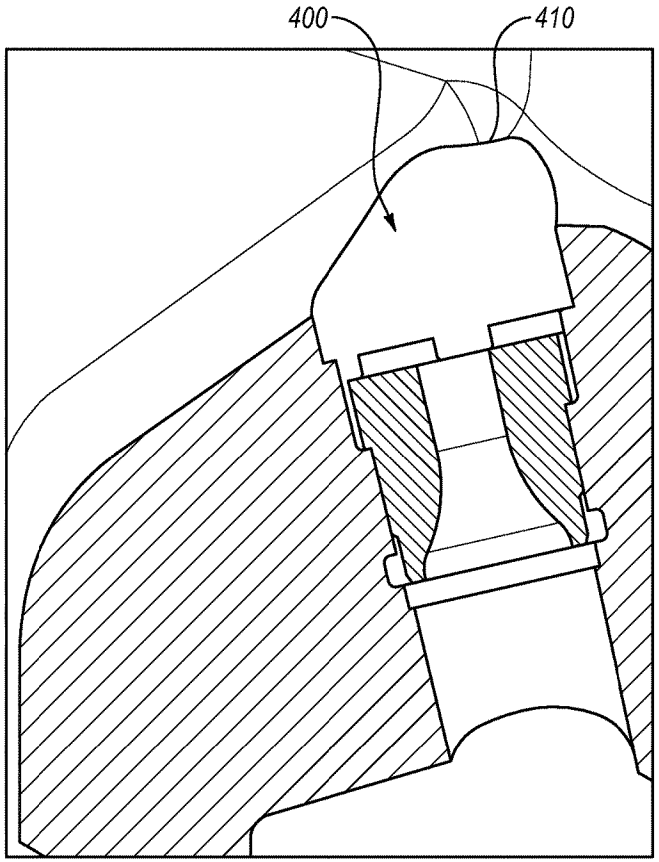
FIG. 4 (Prior Art)
FIG. 4 shows a cross-sectional view and a perspective view of a conventional nozzle bore.
Figure 4:
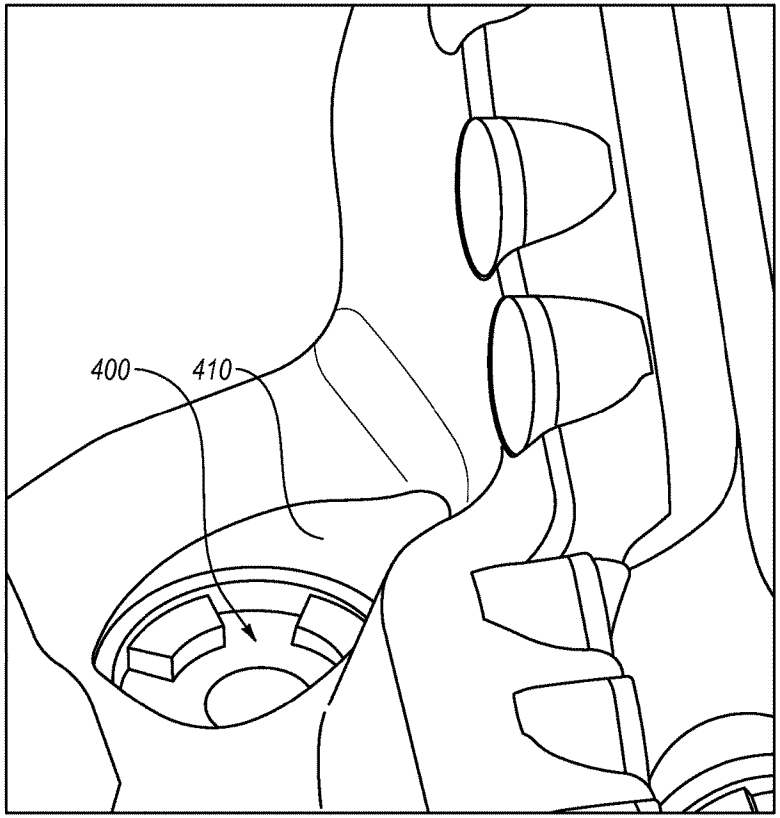
FIG. 4 (Prior Art)
Figure 5:
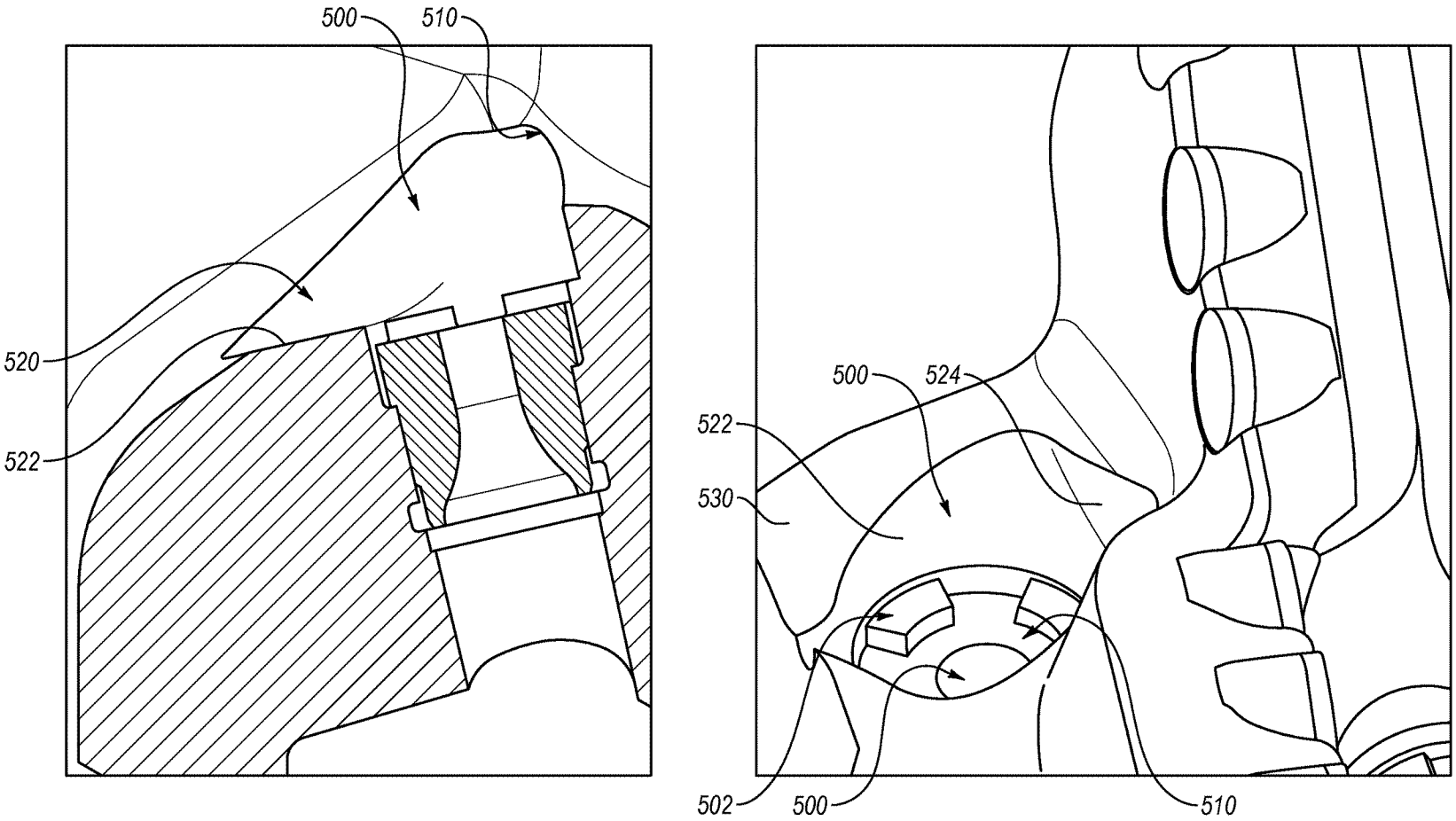
FIG. 5 shows a cross-sectional view and a perspective view of a nozzle bore having a formation evacuation channel according to embodiments of the present disclosure.

According to embodiments of the present disclosure, at least one formation evacuation channel 250 may extend through at least one of the nozzle bores 240 formed in a bit body 210. Particularly, a formation evacuation channel 250 may be formed through the intersecting surface 245 of a nozzle bore 240 such that the intersecting surface of the nozzle bore does not extend completely around the nozzle bore. A conventional nozzle bore 400 without a formation evacuation channel and a nozzle bore 500 of the present disclosure having a formation evacuation channel are shown in FIGS. 4 and 5, respectively. Specifically, a cross-sectional view and a perspective view of a conventional nozzle bore 400 are shown in FIG. 4. As shown, a conventional nozzle bore 400 has a intersecting surface 410 between the bit body surface and an inner surface of the nozzle bore that extends completely around the nozzle bore. The intersecting surface 410 is substantially perpendicular to a nozzle face disposed in the nozzle bore 400. However, in some embodiments, an intersecting surface may be configured non-perpendicularly (e.g., ranging from greater than 60° to less than 90° from a nozzle face, or ranging from greater than 90° to less than 180° from a nozzle face), but still form a boundary to the nozzle bore. In some circumstances, the intersecting surface 410 may act as a dam, obstructing the flow of cuttings through the junk slots and away from the bit, which may lead to packing around the nozzle and eventually bit-balling. Advantageously, by forming a formation evacuation channel of the present disclosure through a portion of the nozzle bore ledge, accumulation of cuttings around the nozzle may be eliminated.

Figure 21:
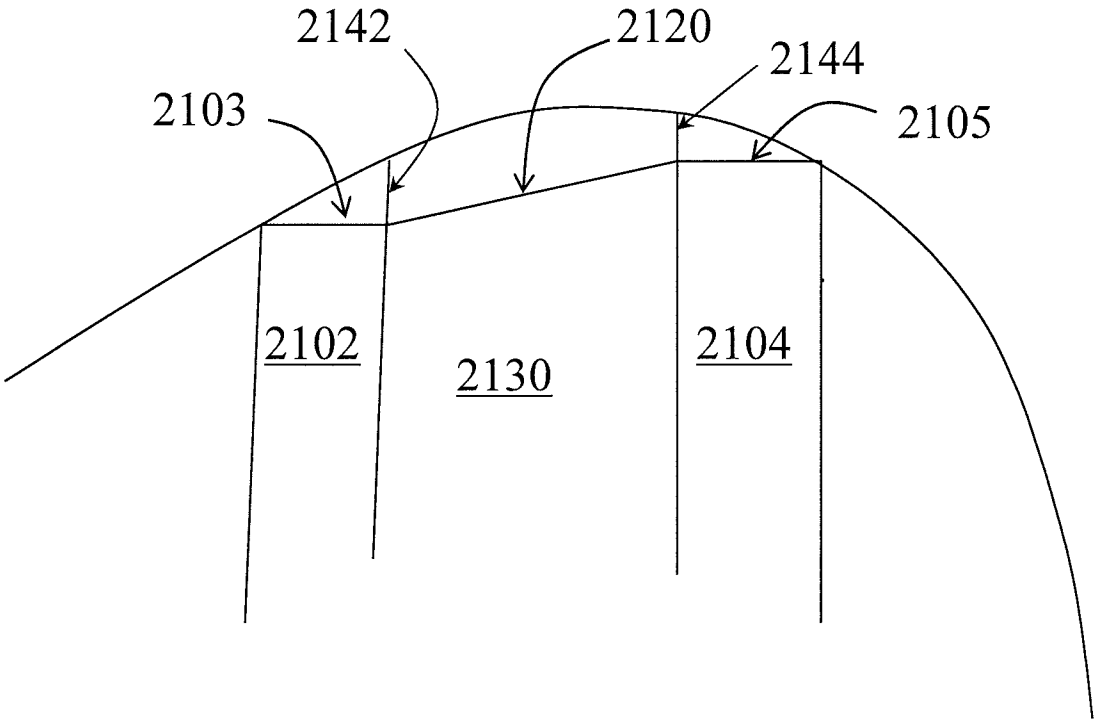
FIG. 21 shows a cross-sectional view of a bit body according to embodiments of the present disclosure.

Further, according to embodiments of the present disclosure, at least one formation evacuation channel may extend through the ledges of more than one nozzle bore. For example, as shown in FIG. 21, at least one formation evacuation channel 2120 may extend through the ledges 2142, 2144 of one nozzle bore 2102 to a second nozzle bore 2104 formed in a bit body 2130. As shown, the formation evacuation channel 2120 may transition from a nozzle face 2103 in the first nozzle bore 2102 to a nozzle face 2105 in the second nozzle bore 2104.

Figure 17:
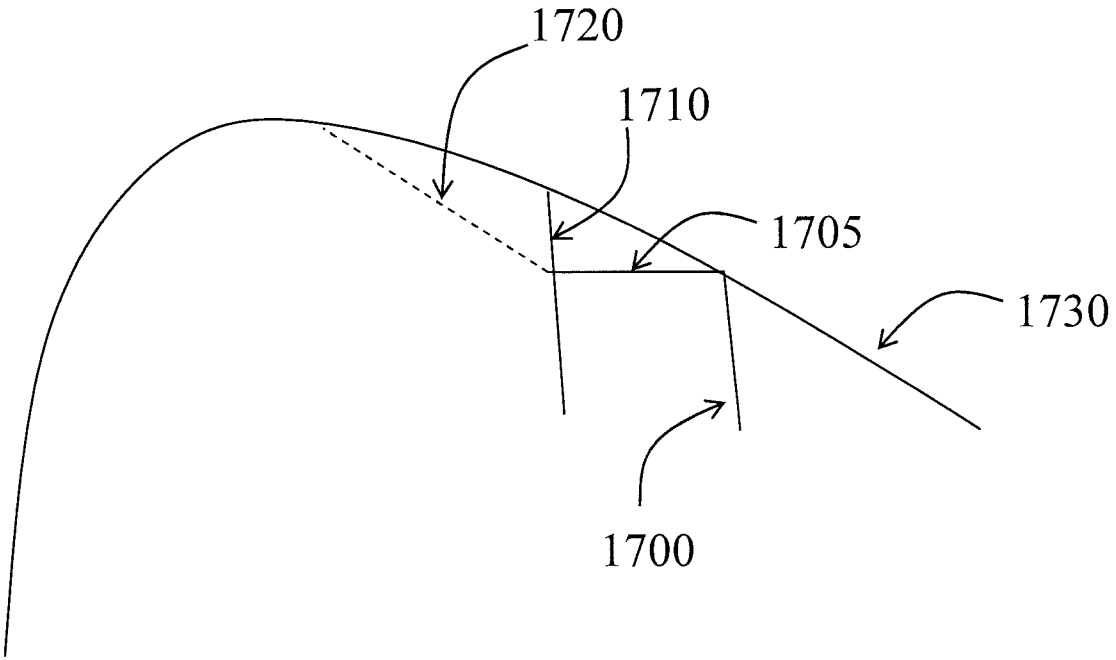
FIG. 17 shows a cross-sectional view a bit according to embodiments of the present disclosure.

A cross-sectional view and a perspective view of a nozzle bore 500 of the present disclosure are shown in FIG. 5. As shown, a formation evacuation channel 520 is formed through the intersecting surface 510 between the bit body surface and inner surface of a nozzle bore 500 such that the intersecting surface 510 does not extend completely around the nozzle bore 500. The formation evacuation channel 520 has a base surface 522 and two side surfaces 524. The base surface 522 is substantially flush with a nozzle face 502 disposed within the nozzle bore 500 and transitions into the bit body surface 530. However, in some embodiments, the base surface may slope downwardly from a nozzle face to transition into the bit body surface. When referring to FIG. 5, the term "downwardly" is used to refer to the direction generally going from the cutting face of a bit to the connection end of the bit. In some embodiments, the base surface may slope upwardly (i.e., the direction generally going from the connection end of the bit to the cutting face of the bit) from a nozzle face to transition into the bit body surface. For example, FIG. 17 shows a bit profile 1730 having a nozzle bore 1700 formed within the bit and an intersecting surface 1710 formed between the bit body surface 1730 and inner surface of the nozzle bore 1700 that extends partially around the nozzle bore 1700, wherein a formation evacuation channel 1720 slopes upwardly from the nozzle face 1705 to transition into the bit body surface 1730. According to embodiments of the present disclosure, the base surface may form an angle with the nozzle face ranging from greater than −90° (downward slope) to less than 90° (upward slope). Further, the base surface may be flat, curved, concave, or have other surface geometries formed therein. Advantageously, by providing a transition from a nozzle face to the bit body surface, the base surface acts as a slide or ramp for cuttings to flow through.

Figure 6:
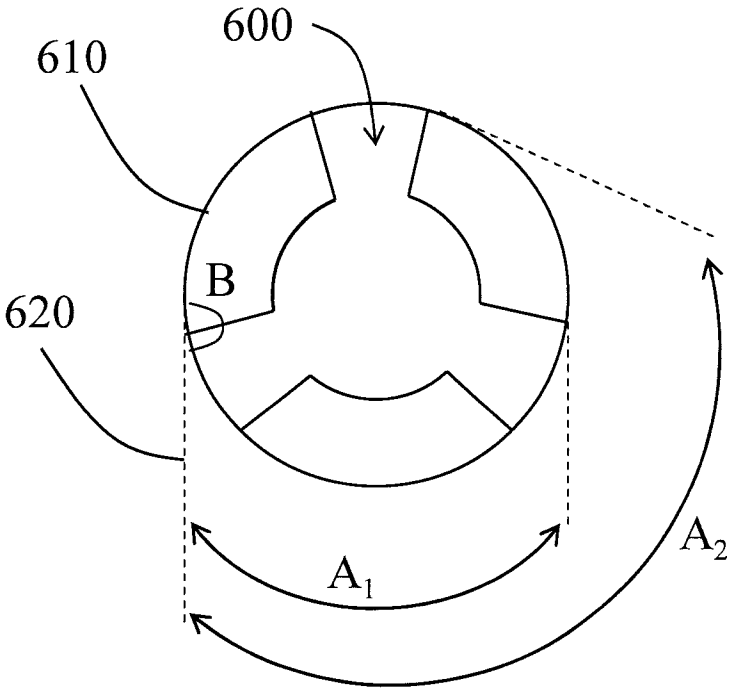
FIG. 6 shows a diagram of a formation evacuation channel according to embodiments of the present disclosure.
Figure 20:
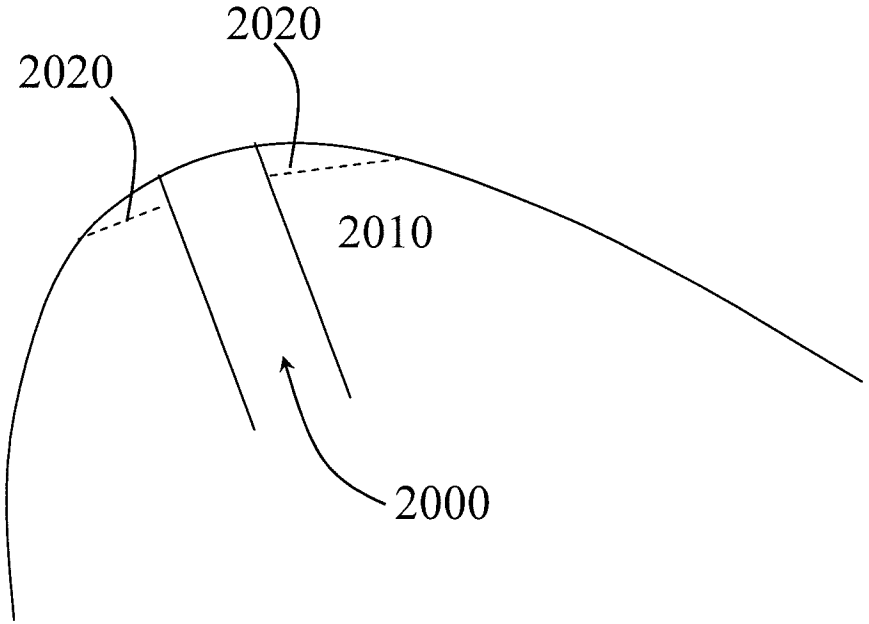
FIG. 20 shows a cross-sectional view of a bit body according to embodiments of the present disclosure.

The side surfaces of a formation evacuation channel may extend radially outward from the nozzle bore such that the base surface of the formation evacuation channel extends partially around the circumference of the nozzle bore. For example, FIG. 6 shows a diagram of a formation evacuation channel 620, wherein the base surface extends an arc length $A_1$ around the circumference of a nozzle bore 600. As shown, the arc length $A_1$ may extend around half (i.e., 50%) of the circumference of the nozzle bore 600. However, in some embodiments, the arc length of a formation evacuation channel may extend a lower limit of any of 25, 30, 45, 50, 60, 65 to an upper limit of any of 40, 50, 60, 65, or 75, with any lower limit being used in combination with any upper limit For example, as shown in FIG. 6, an arc length $A_2$ may extend around 70% of the circumference of the nozzle bore 600. In other embodiments, a formation evacuation channel may extend 60% around a nozzle bore, 65% in other embodiments, and up to 75% in yet other embodiments. According to some embodiments, a formation evacuation channel (or multiple formation evacuation channels adjacent to each other) may extend up to the entire circumference around a nozzle bore. For example, as shown in FIG. 20, a nozzle bore 2000 may be formed at the edge of a curve in a bit body 2010, wherein a formation evacuation channel 2020 extends around the entire circumference of the nozzle bore 2000. Further, although the formation evacuation channel is shown as extending an arc length around a circular nozzle bore in FIG. 6, a formation evacuation channel may extend around nozzle bores having other shapes, such as an ellipse, for example.

The two side surfaces 620 extend radially outward from the intersecting surface 610 of the nozzle bore 600, forming an angle B with the intersecting surface 610. In some embodiments, the angle B may be constant along the intersection of the side surface 620 and the intersecting surface 610. However, in other embodiments, the angle B may vary along the intersection of the side surface 620 and the intersecting surface 610. Side surfaces may extend an angle B ranging from a lower limit of any of 180, 210, and 240 to an upper limit of any of 210, 240 and 270 with any lower limit value being used in combination with any upper limit value. For example, as shown in FIG. 6, a side surface 620 may extend tangentially from a point along the intersecting surface 610, forming an angle of 180° with the intersecting surface. Further, a side surface 620 may transition from the intersecting surface 610, such as to form a curved ledge to side surface, or alternatively, a side surface may intersect with the intersecting surface to form an edge.

Referring again to FIG. 5, at least one of the side surfaces 524 of a formation evacuation channel 520 may be a diminishing side surface. A diminishing side surface is a surface that extends downwardly from the intersecting surface 510 of a nozzle bore 500 toward the bit body surface 530, such that the surface decreases in height from the height of the intersecting surface to the bit body surface. However, in some embodiments, at least one diminishing side surface may intersect with a blade or a side surface of another formation evacuation channel, thus extending downwardly from the intersecting surface to a blade side wall or to the side surface of another formation evacuation channel. Further, in some embodiments, one or more side surfaces may increase in height or may have a constant height.

A formation evacuation channel may have two diminishing side surfaces, or alternatively, a formation evacuation channel may have only one diminishing side surface. For example, a formation evacuation channel may be formed in a nozzle bore adjacent to a blade such that a side wall of the blade forms one side surface of the formation evacuation channel and a diminishing side surface forms the other side surface of the formation evacuation channel. In other embodiments, a formation evacuation channel may have no diminishing side surfaces, but instead may have other forms of side surfaces, such as blade side walls or side surfaces that do not extend downwardly from the nozzle bore intersecting surface, i.e., side surfaces that do not decrease in height from the bit body surface to the intersecting surface. Furthermore, side surfaces may have a sloped or curved transition into the base surface. Alternatively, a side surface may intersect the base surface substantially perpendicularly. Further, according to some embodiments, one or more side surfaces may increase in height or may have a constant height.

Figure 7:
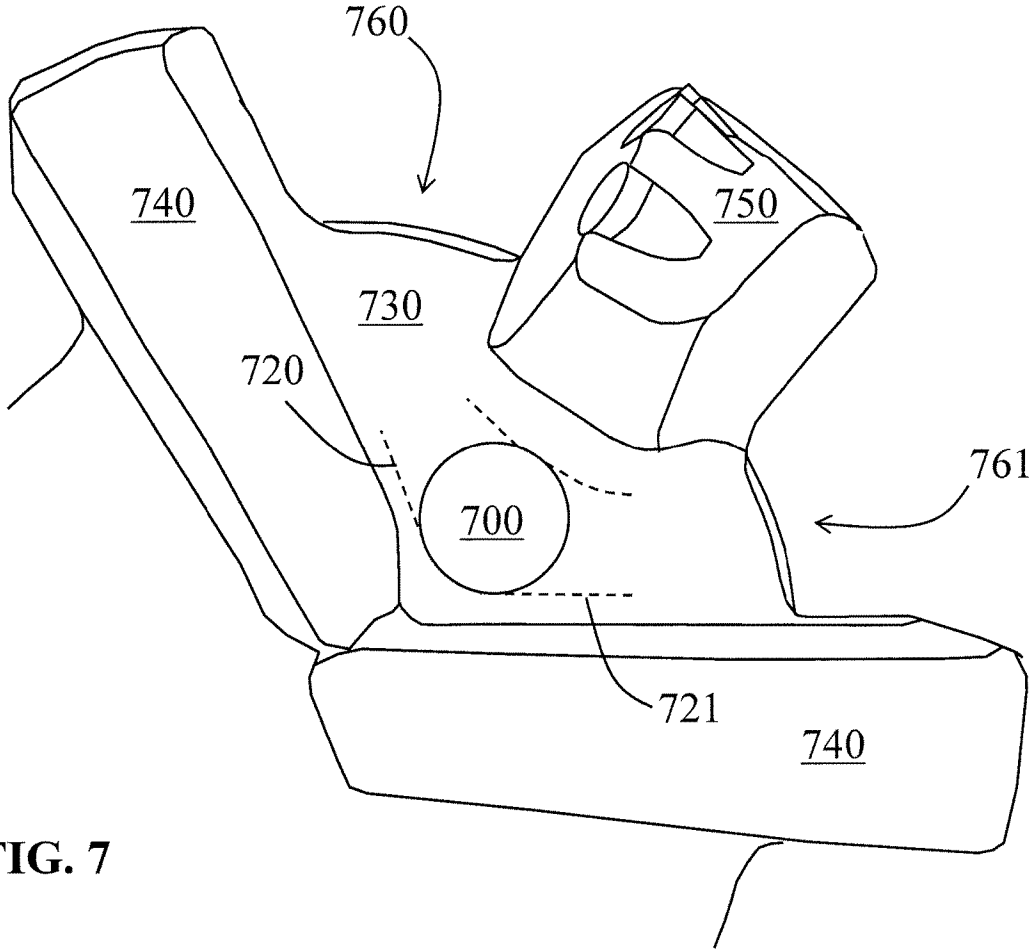
FIG. 7 shows a top view of a section of a drill bit according to embodiments of the present disclosure.

In some embodiments, two or more formation evacuation channels may be formed through the intersecting surface of a nozzle bore, wherein each formation evacuation channel is defined by two side surfaces and a base surface. In such embodiments, for example, each formation evacuation channel may be directed through a separate junk slot. For example, referring to FIG. 7, a top partial view of a drill bit 700 is shown in accordance with embodiments of the present disclosure. As shown, a nozzle bore 700 having two formation evacuation channels 720, 721 is formed in a bit body 730. The bit body 730 has at least one primary blade 740 extending substantially to the center of the bit and at least one secondary blade 750 extending a distance from the center of the bit, wherein junk slots 760, 761 are formed between the blades. The nozzle bore 700 is formed in the junk slot area 760 between two primary blades 740 and adjacent to a secondary blade 750 (radially inward with respect to secondary blade 750). As shown, two formation evacuation channels 720 are formed through the nozzle bore 700, wherein a first formation evacuation channel 720 is directed through one junk slot 760 and a second formation evacuation channel 721 is directed through another junk slot 761.

Figure 18:
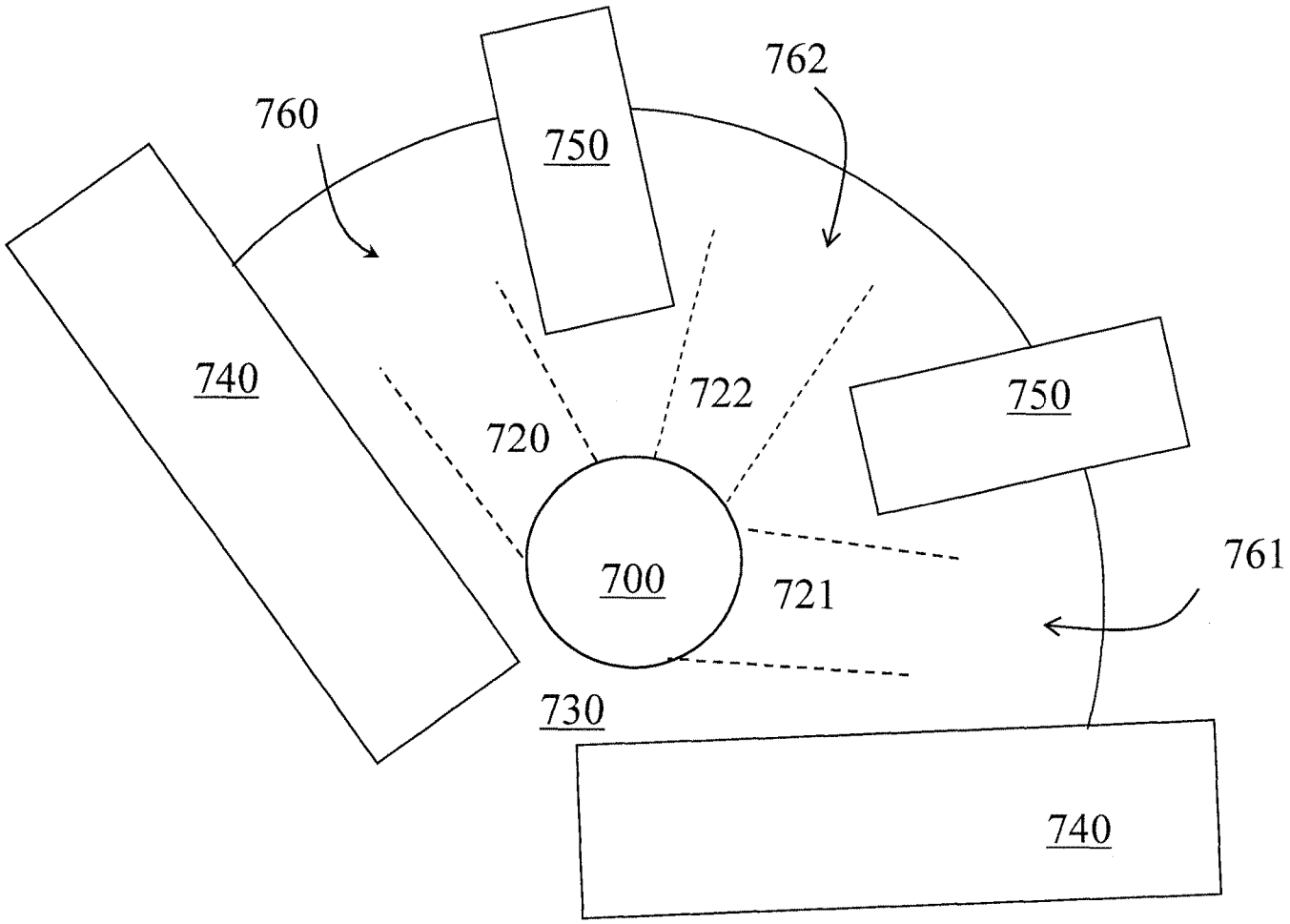
FIG. 18 shows a top view of a section of a drill bit according to embodiments of the present disclosure.

FIG. 18 shows another example of two or more formation evacuation channels formed through a intersecting surface of a nozzle bore. As shown, a nozzle bore 700 having three evacuation channels 720, 721, 722 are formed in a bit body 730. The bit body 730 has at least one primary blade 740 extending substantially to the center of the bit and at least one secondary blade 750 extending a distance from the center of the bit, wherein junk slots 760, 761, 762 are formed between the blades. The nozzle bore 700 is formed in the junk slot area 760 between two primary blades 740 and adjacent to the secondary blades 750 (radially inward with respect to secondary blades 750). As shown, three formation evacuation channels 720, 721, 722 are formed through the nozzle bore 700, wherein a first formation evacuation channel 720 is directed through one junk slot 760, a second formation evacuation channel 721 is directed through a second junk slot 761, and a third formation evacuation channel 722 is directed through a third junk slot 762.

Figure 9:
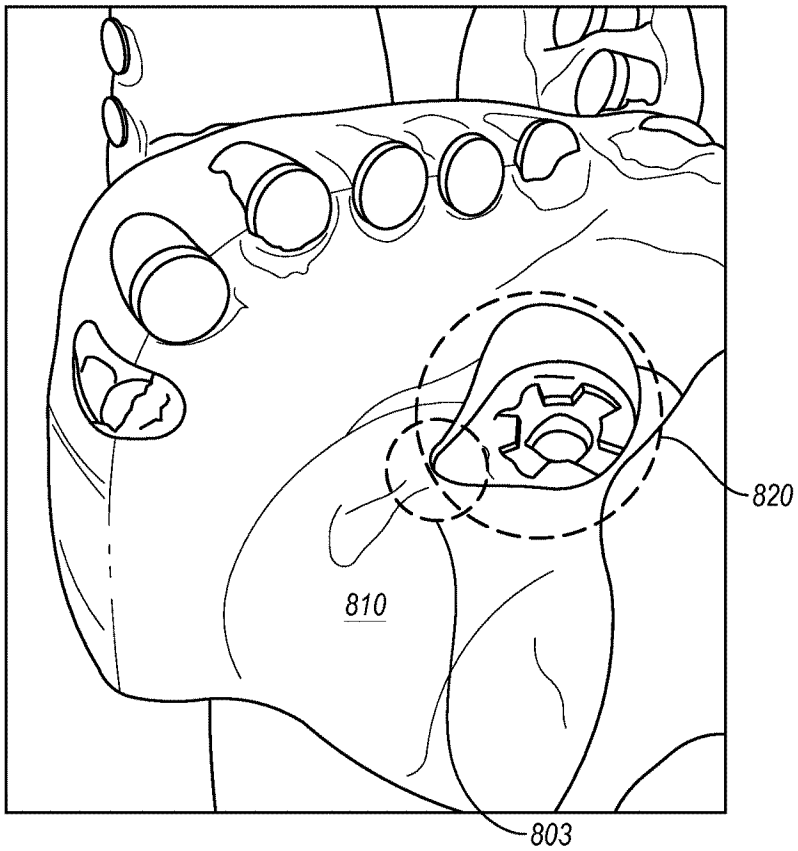
FIG. 9 shows a perspective view of a nozzle bore formed in a drill bit according to embodiments of the present disclosure.
Figure 8:
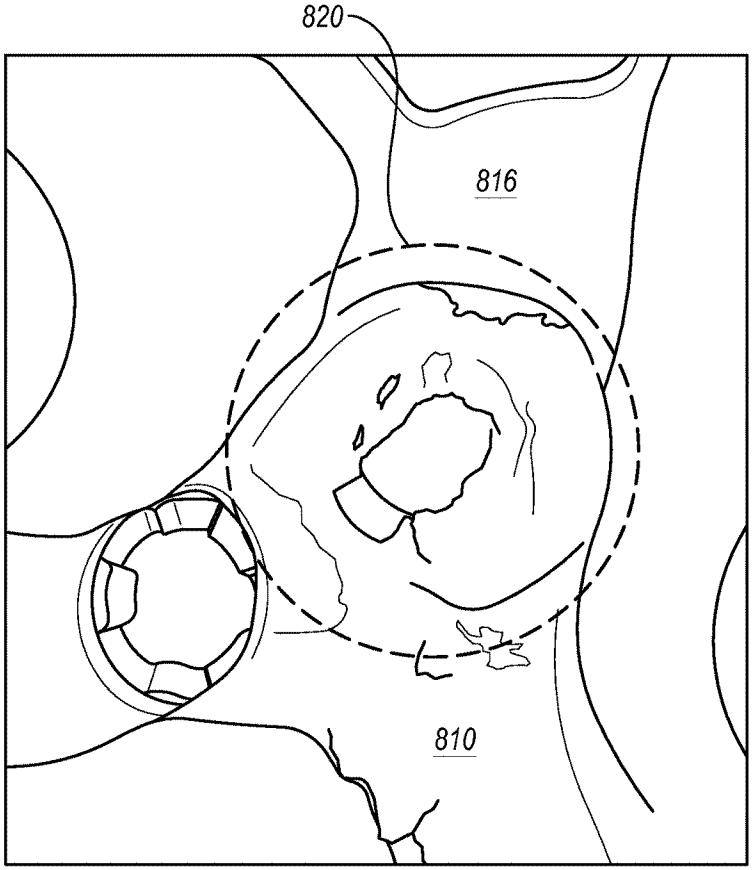
FIG. 8 (Prior Art)
FIG. 8 shows a top view of a conventional nozzle bore formed in a drill bit.

Advantageously, by forming formation evacuation channels according to embodiments of the present disclosure, flow through the junk slot areas of a bit may be improved and shale packing within the orifices or nozzle bores of the bit may be reduced or eliminated. For example, FIGS. 8 and 9 show a conventional drill bit without a formation evacuation channel and a drill bit having a formation evacuation channel according to embodiments of the present disclosure, respectively. As shown in FIG. 8, a bit body 810 has a conventional nozzle bore 820 (a nozzle bore having no formation evacuation channel) formed therein. After drilling through an earthen formation, such as a shale formation, the nozzle bore 820 has shale cuttings packed therein. Particularly, the intersecting surface formed between the bit body surface and inner surface of the nozzle bore that extends around the nozzle bore may act as an obstruction to the flow of the formation cuttings, thereby collecting and compacting the cuttings within the nozzle bore 820. As shown in FIG. 9, a bit body 910 has a nozzle bore 920 with a formation evacuation channel 930 extending there through, according to embodiments of the present disclosure. After drilling through the earthen formation having shale, the nozzle bore 920 is substantially free of cuttings. Particularly, during the drilling operations, the cuttings may be channeled through the formation evacuation channel and away from the bit.

Figure 11:
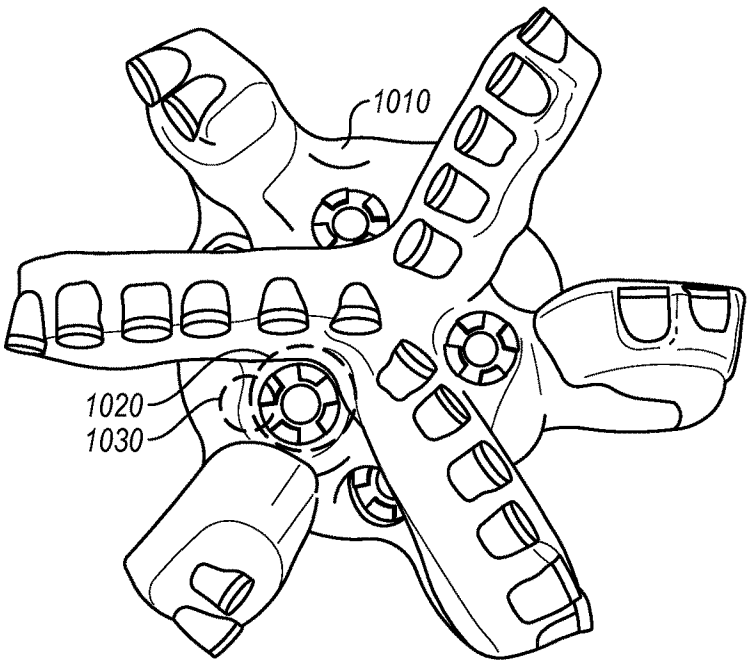
FIG. 11 shows a nozzle bore having a formation evacuation channel formed in a drill bit according to embodiments of the present disclosure.
Figure 10:
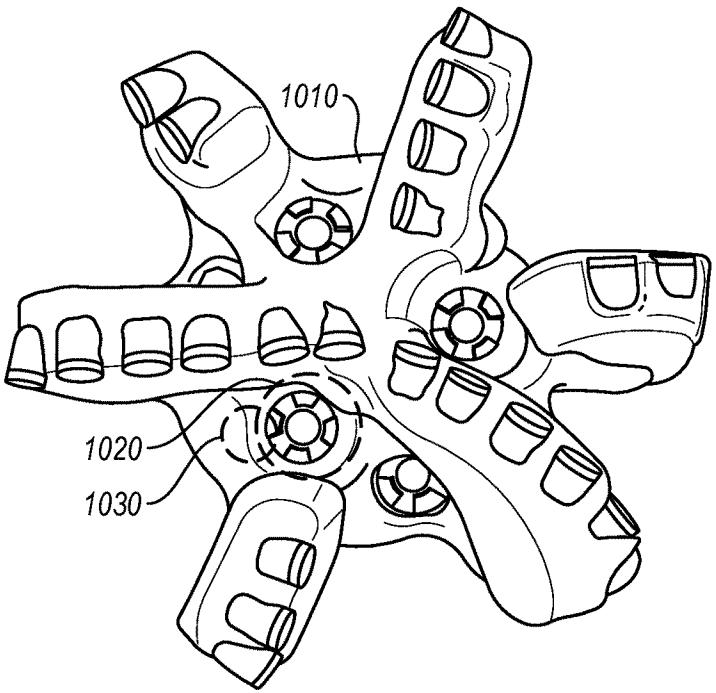
FIG. 10 shows a nozzle bore having a formation evacuation channel foil led in a drill bit according to embodiments of the present disclosure.

FIGS. 10 and 11 also show drill bits 1000 having a bit body 1010 with nozzle bores 1020 and formation evacuation channels 1030 formed therein. Each bit 1000 conducted two runs through an earthen formation comprising shale. Upon completion of the two runs, no shale packing was observed in the nozzle bores 1020. Particularly, during the drilling operations, the shale cuttings may be channeled through the formation evacuation channels and away from the bit, thus resulting in no shale packing within the nozzle bores.

According to other embodiments of the present disclosure, a nozzle bore may have no formation evacuation channels formed there through. For example, according to some embodiments, a drill bit may have a bit body with a longitudinal axis extending there through and a plurality of blades extending from the bit body, with junk slots formed between adjacent blades. At least one nozzle bore may be formed in a junk slot of the bit body, wherein each nozzle bore has a radiused transition between the bit body surface of a junk slot and an inner surface of the nozzle bore. The radiused transition may extend completely around the nozzle bore, or alternatively, the radiused transition may extend partially around the nozzle bore. Further, a drill bit according to embodiments of the present disclosure may have various combinations of nozzle bores described herein. For example, a bit may have one or more nozzle bores with a radiused transition between the bit body surface and inner surface of the nozzle bore formed around the entire nozzle bore, one or more nozzle bores with a radiused transition formed around part of the nozzle bore, and/or one or more nozzle bores with an abrupt intersecting surface between the bit body surface and inner surface of the nozzle bore. Additionally, drill bits of the present disclosure may have various combinations of nozzle bores with zero, one, or more than one formation evacuation channels formed therein.

According to some embodiments of the present disclosure, a drill bit may also have an ogival shaped bit body, referred to herein as a high sloping body. High sloping bodies of the present disclosure may be distinguished from conventional drill bit bodies by their bullet-like shape. Particularly, high sloping bodies may have a conoidal end and a shaft, wherein at least a portion of the bit body surface forming junk slots forms the conoidal end. The conoidal end may have a slope of greater than 110° when measured with respect to the longitudinal axis of the drill bit. For example, high sloping bodies according to some embodiments of the present disclosure may have a slope greater than 115°, greater than 120° in some embodiments, and greater than 125° in other embodiments. In contrast, when measuring a correspondingly positioned slope in conventional drill bits having a sloping bit body surface, the slopes have been limited to ranging between 90° and 108° (or negatively sloping body profiles, such as in matrix bit bodies).

Figure 12:
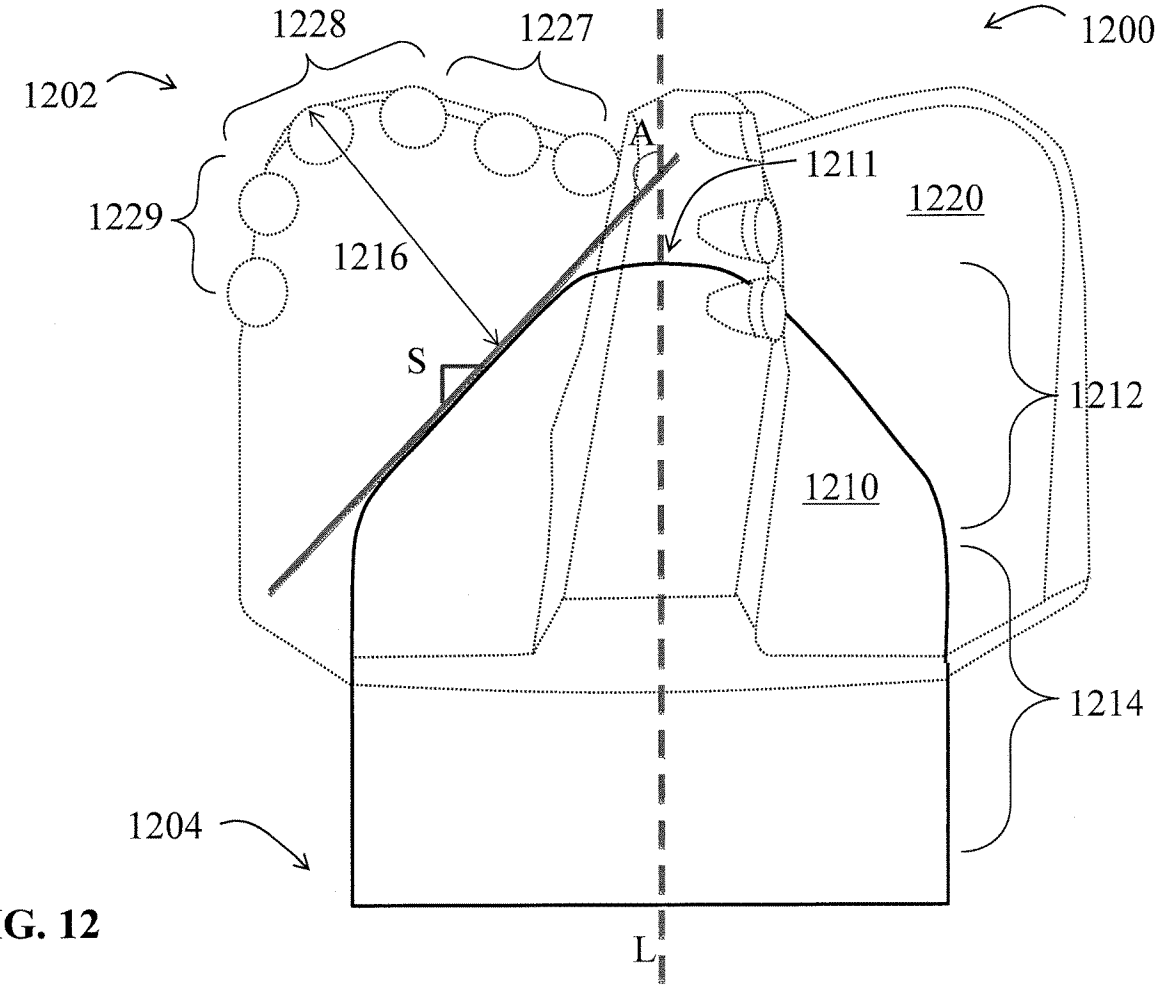
FIG. 12 shows a diagram of a drill bit according to embodiments of the present disclosure.

For example, FIG. 12 shows the slope of a high sloping body according to embodiments of the present disclosure. As shown, a drill bit 1200 has a high sloping body 1210 and a longitudinal axis L extending there through. A plurality of blades 1220 extend radially from the high sloping body 1210 and axially along the high sloping body surface from a cutting end 1202 of the drill bit 1200 towards a connection end 1204 of the drill bit, wherein the blades (and/or cutting elements disposed on the blades) at the cutting end 1202 contact and cut the formation to be drilled. Junk slots are formed between the blades 1220, wherein each junk slot is defined by the bit body surface and adjacent blade side walls. As least a portion of the bit body 1210 surface forming the junk slots forms a conoidal end 1212, wherein the conoidal end 1212 faces the drill bit cutting end 1202. The high sloping body 1210 also has a shaft 1214 that extends toward the drill bit connection end 1204. The conoidal end 1212 of the high sloping body 1210 has a slope S, which forms an angle A greater than 110° with the longitudinal axis L. According to some embodiments, the conoidal end of a high sloping body may have a slope that forms an angle with the longitudinal axis that is greater than 120°. For example, the conoidal end of a high sloping body may have a slope that forms an angle with the longitudinal axis that is about 130°. According to other embodiments, the conoidal end of a high sloping body may have a slope that forms an angle with the longitudinal axis of up to 160°. Further, the slope may be flat or curved or include a combination of flat and curved surfaces.

The slope S of a high sloping body may be measured at the point of the high sloping body corresponding with the part of a blade 1220 having the highest radius of curvature, as represented by reference number 1216. Alternatively, the slope S of a high sloping body 1210 may be measured at the point of the high sloping body corresponding with the shoulder region 1228 of a blade 1220. Particularly, a blade profile of a drag bit may be divided into three regions: a cone region 1227, a shoulder region 1228, and a gage region 1229. The cone region 1227 includes the central region of the bit cutting end 1202 and is concave in the bit shown in FIG. 12 (but may be flat in other embodiments). Adjacent to the cone region 1227 is the shoulder region 1228, which curves in the direction opposite of the cone region in the bit shown in FIG. 12. Next to the shoulder region 1228 is the gage region 1229, which is the portion of the cutting end 1202 that defines the diameter or gage of the borehole being drilled. Blade profile regions are also described in U.S. Pat. No. 7,621,348, for example.

Figure 19A:
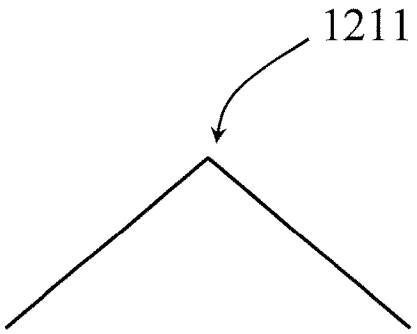
FIG. 19 shows bit body profile geometries according to embodiments of the present disclosure.
Figure 19B:
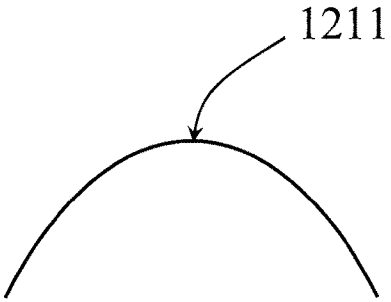
Figure 19C:
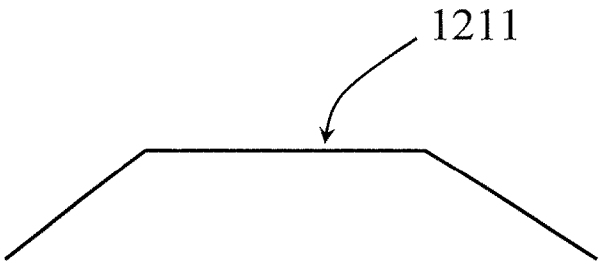
Figure 19D:
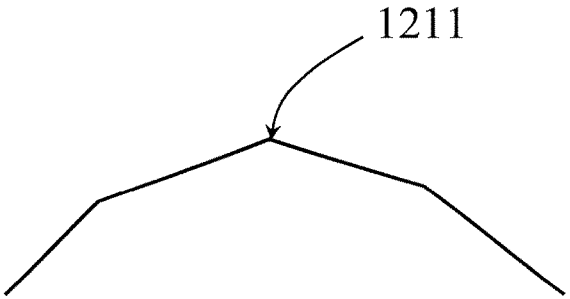

Further, the conoidal end 1212 of the high sloping body 1210 may have a tip 1211. As shown in FIG. 12, the tip 1211 of the high sloping body 1210 is flattened at the point intersecting the longitudinal axis L. When measured at the flattened point intersecting the longitudinal axis L, the tip 1211 may extend straight or have varying slopes or radii of curvature. For example, FIG. 19A-D shows various profile geometries of a tip 1211 according to embodiments of the present disclosure, including an conical tip (FIG. 19A), a paraboloid (FIG. 19B), a truncated cone (FIG. 19C), and a stepped tip (FIG. 19D).

Figure 13:
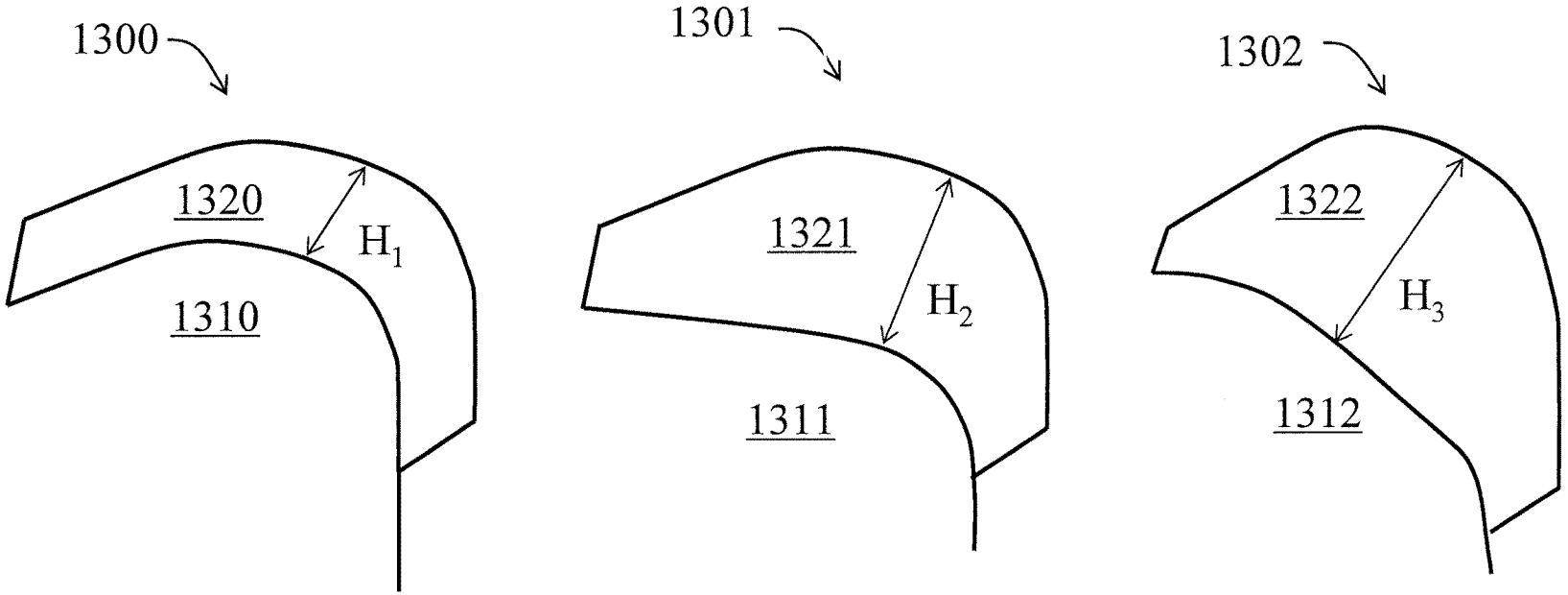
FIG. 13 shows cross-sectional partial views of drill bit blades extending a height from bit bodies.

According to some embodiments of the present disclosure, high sloping bodies may be made of steel. In such embodiments, the drill bit may have taller and thinner blades without increased risk of blade failure when compared with conventional drill bits made of a matrix material. By having taller and thinner blades, a larger junk slot area may be achieved, thus providing a larger area for formation cuttings to flow through. Further, being able to use relatively taller blades allows for use of a high sloping bit body. For example, FIG. 13 shows comparison cross-sectional diagrams of blade heights on different bit body shapes. The height of a blade is generally measured from the bit body surface to the blade's outer face. As shown, a drill bit 1300 having a matrix material bit body 1310 has a blade 1320 extending a height $H_1$. A drill bit 1301 having a steel bit body 1311 has a blade 1321 extending a height $H_2$, wherein the bit body 1311 has a downwardly sloping bit body surface, thereby giving the bit body 1311 a dull spear or hill-like shape. Due to the downwardly sloping shape of bit body 1311 (rather than the upwardly curving shape of bit body 1310), the distance from the outer face of the blade 1321 to the surface of the bit body 1311, i.e., $H_2$, is greater than the height $H_1$ of blade 1320. Drill bit 1302 also has a bit body 1312 made of steel and a blade 1322 extending a height $H_3$ from the bit body 1312. However, bit body 1312 has a high sloping shape according to embodiments of the present disclosure (described above). Particularly, bit body 1312 has a steeper sloping surface than that of bit body 1311. Thus, the distance from the outer face of the blade 1322 to the surface of the bit body 1312, i.e., $H_3$, is greater than the height $H_2$ of blade 1321.

Figure 14:
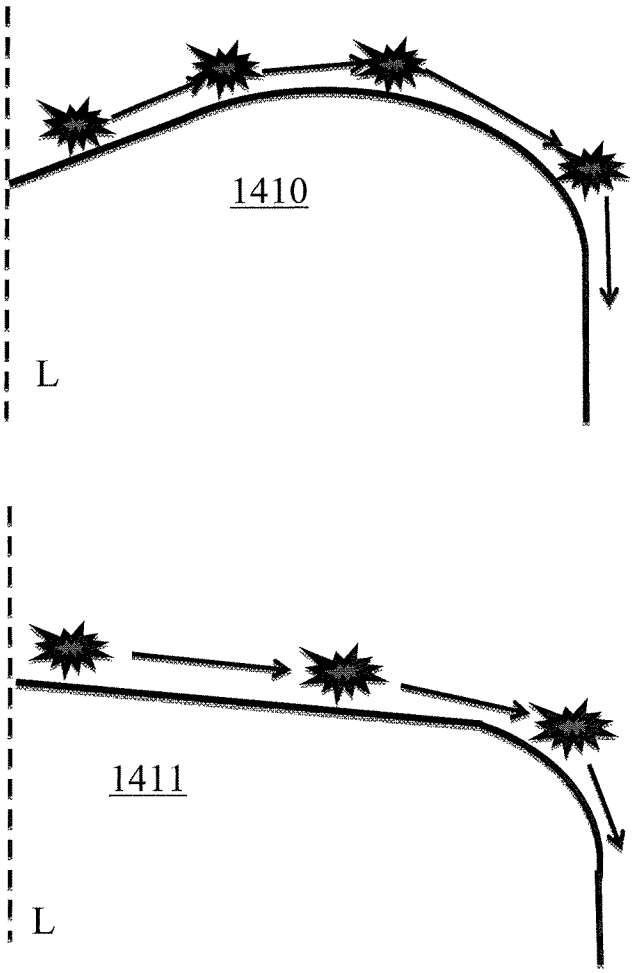
FIG. 14 (Prior Art)
FIG. 14 shows a diagram of cuttings evacuation along conventionally shaped bit bodies.

Steel bit bodies having a generally downwardly sloping surface may have improved cuttings evacuation when compared with conventionally shaped matrix material bit bodies or conventionally shaped steel bit bodies. For example, FIG. 14 shows comparison diagrams of a cross-sectional view of a conventionally shaped matrix bit body 1410 and a conventionally shaped steel bit body 1411. As shown, the tendency of cuttings surrounding the conventionally shaped matrix bit body 1410 may be to accumulate at the center, or longitudinal axis L, of the bit. However, the tendency of cuttings around the gradually sloping body profile of bit body 1411 is to slide naturally along the profile of the bit body 1411 and not to accumulate at the center, or longitudinal axis L, of the bit.

Figure 15:
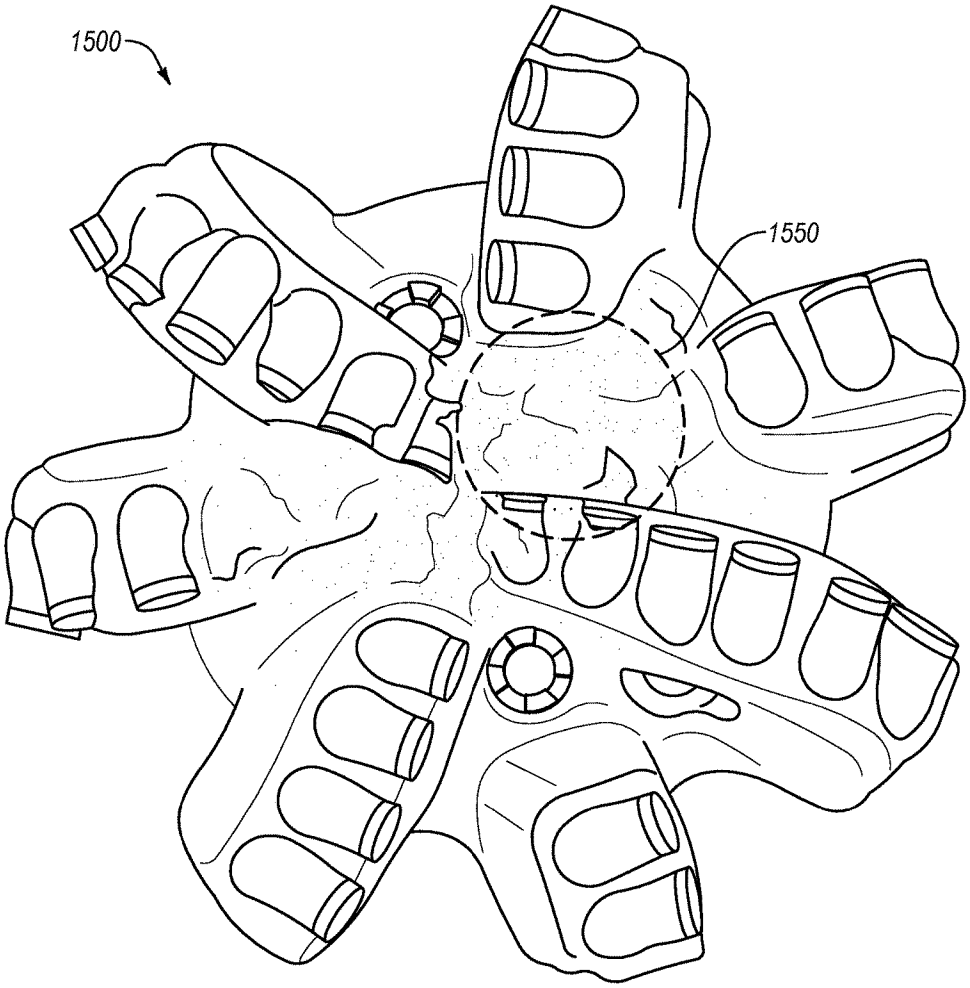
FIG. 15 (Prior Art)
FIG. 15 shows a top view of a conventional drill bit.
Figure 16:
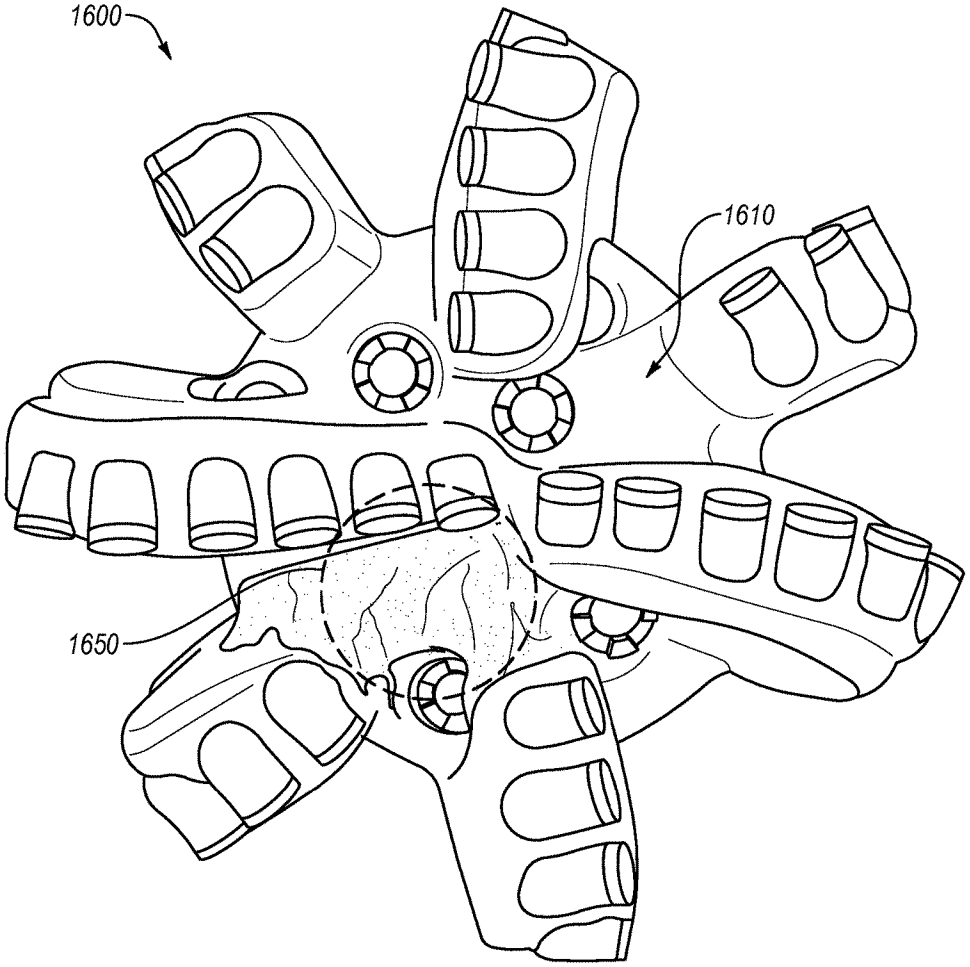
FIG. 16 (Prior Art)
FIG. 16 shows a top view of a conventional drill bit.

Further, FIGS. 15 and 16 show a picture of a conventionally shaped matrix material drill bit 1500 and a picture of a conventionally shaped steel drill bit 1600, respectively, which have been used to drill through shale formations. In particular, the matrix material drill bit 1500 shown in FIG. 15 has a conventionally shaped bit body, such as shown in FIG. 14, wherein cuttings 1550 have accumulated at the center of the bit (often referred to as shale packing) after drilling operations in a shale formation. The inventors of the present disclosure have found that about 95% of drilling runs of the drill bit 1500 through shale formations resulted in shale packing. Referring now to FIG. 16, the drill bit 1600 has a steel bit body 1610 with a gradually sloping spear shape, similar to the shape of bit body 1411 shown in FIG.

14. Cuttings may slide along the profile of the bit body and away from the center of the bit; however, some instances of shale packing are still observed. Particularly, inventors of the present disclosure have found that about 35% of drilling runs of the drill bit 1600 through shale formations resulted in shale packing. However, inventors of the present disclosure have found a way to form drill bits having high sloping bit bodies, which may have improved cuttings evacuation over conventionally shaped bit bodies, and thus a further reduced incidence of shale packing.

Formation evacuation channels according to embodiments of the present disclosure may be particularly useful in drill bits of the present disclosure having a high sloping body, as described above. Particularly, because of the high slope in the bit body shape, an intersecting surface between the bit body surface and inner surface of the nozzle bore, or ledge, is created by forming a nozzle bore within the bit body. Such intersecting surfaces may obstruct the flow of cuttings, and thus lead to packing around the nozzle. Thus, by using formation evacuation channels according to embodiments of the present disclosure, cuttings may flow through the intersecting surfaces created by the nozzle bores formed in high sloping bodies.

Advantageously, the inventors of the present disclosure have found that by forming a drill bit having at least one of the cuttings evacuation elements described above, i.e., a formation evacuation channel and a high sloping body, the drill bit may drill through shale formations with a significantly reduced amount of shale packing when compared with conventionally formed drill bits. For example, drill bits of the present disclosure may include a high sloping body and at least one formation evacuation channel. Alternatively, drill bits of the present disclosure may have at least one formation evacuation channel formed in a bit body having a shape other than a high sloping body, such as a conventionally formed matrix material drill bit body or a gradually sloping steel bit body. Bit bodies formed of a matrix material may include a carbide grains, such as tungsten carbide, bonded together by a binder material, such as cobalt. However, other matrix materials used to form matrix material bit bodies known in the art may be used in combination with at least one formation evacuation channel.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A drill bit, comprising:

a bit body having a longitudinal axis extending therethrough;

a plurality of blades extending from the bit body, wherein each blade has an outer face and at least one side wall, at least one blade including a concave cone region adjacent to the axis of the bit, a gage region at an outer circumference of the bit, and a convex shoulder region extending between the cone region and the gage region;

at least one junk slot, wherein each junk slot is defined by the bit body surface and the side walls of adjacent blades;

at least one nozzle bore formed in the bit body, wherein each nozzle bore comprises an intersecting surface between the bit body surface of a junk slot and an inner surface of the nozzle bore, wherein the intersecting surface does not extend completely around the at least one nozzle bore and defines a ledge at an angle with the bit body surface; and at least one formation evacuation channel extending through the ledge of the intersecting surface of at least one of the nozzle bores, each formation evacuation channel comprising a base surface extending from the corresponding nozzle bore toward an outer radial surface of the junk slot in which the nozzle bore is formed;

wherein the formation evacuation channel extends partially around the circumference of the nozzle bore, wherein at least a portion of the bit body surface forming the junk slots comprises a conoidal end, and wherein the at least one nozzle bore is located at a portion of the conoidal end of the junk slot having a constant slope.

2. The drill bit of claim 1, wherein the conoidal end has a slope of greater than 110° when measured with respect to the longitudinal axis.

3. The drill bit of claim 2, wherein the conoidal end has a slope of greater than 120° when measured with respect to the longitudinal axis.

4. The drill bit of claim 1, further comprising a nozzle disposed in each nozzle bore, wherein the nozzle comprises a nozzle face exposed within the nozzle bore.

5. The drill bit of claim 4, wherein the base surface is flush with the nozzle face.

6. The drill bit of claim 4, wherein the base surface slopes downwardly from the nozzle face to the bit body surface.

7. The drill bit of claim 4, wherein the base surface slopes upwardly from the nozzle face to the bit body surface.

8. The drill bit of claim 1, wherein at least one formation evacuation channel comprises at least one diminishing side surface.

9. The drill bit of claim 8, wherein the diminishing side surface extends from the intersecting surface to the bit body surface.

10. The drill bit of claim 8, wherein the diminishing side surface extends from the intersecting surface to a blade side wall.

11. The drill bit of claim 8, wherein the diminishing side surface extends from the intersecting surface to another side surface of a formation evacuation channel.

12. The drill bit of claim 1, wherein at least one formation evacuation channel comprises at least one side surface that is a blade side wall.

13. The drill bit of claim 1, wherein one of the nozzle bores comprises two formation evacuation channels extending through the ledge of the intersecting surface.

14. The drill bit of claim 1, wherein the at least one formation evacuation channel extends at least 50 percent around the circumference of the at least one nozzle bore.

15. The drill bit of claim 14, wherein the at least one formation evacuation channel extends up to 75% around the circumference of the at least one nozzle bore.

16. The drill bit of claim 14, wherein the at least one formation evacuation channel extends up to the entire circumference of the at least one nozzle bore.

17. The drill bit of claim 1, wherein the bit body comprises steel.

18. The drill bit of claim 1, wherein the bit body comprises a matrix material.

19. The drill bit of claim 1, wherein the plurality of blades comprises at least one primary blade and at least one secondary blade.

20. The drill bit of claim 1, wherein at least one formation evacuation channel comprises at least one side surface having a constant height.

21. The drill bit of claim 1, wherein at least one formation evacuation channel comprises at least one side surface having an increasing height from the intersecting surface to the bit body surface.

22. The drill bit of claim 1, wherein the intersecting surface has a radiused transition between the bit body surface and the inner surface of the nozzle bore.

23. A drill bit, comprising:

a bit body having a longitudinal axis extending therethrough;

a plurality of blades extending from the bit body, wherein each blade has an outer face and at least one side wall;

at least one junk slot, wherein each junk slot is defined by the bit body surface and the side walls of adjacent blades;

at least one nozzle bore formed in the bit body, wherein each nozzle bore comprises an intersecting surface between the bit body surface of a junk slot and an inner surface of the nozzle bore; and at least one formation evacuation channel extending through the intersecting surface of at least one of the nozzle bores, each formation evacuation channel comprising a base surface, wherein the formation evacuation channel extends around at least 25% of the circumference of the nozzle bore, and wherein at least one formation evacuation channel extends through the intersecting surface of one nozzle bore to a second nozzle bore.

24. A drill bit, comprising:

a bit body having a longitudinal axis extending therethrough;

a plurality of blades extending from the bit body, wherein each blade has an outer face and at least one side wall, and at least one blade includes a concave cone region adjacent to the axis of the bit, a gage region at an outer circumference of the bit, and a convex shoulder region extending between the cone region and the gage region;

at least one junk slot, wherein each junk slot is defined by the bit body surface and the side walls of adjacent blades, and wherein at least a portion of the bit body surface defining the junk slots comprises a conoidal end, the conoidal end having a slope of greater than 110° in at least a portion of the cone region of the at least one blade when measured with respect to the longitudinal axis; and at least one nozzle bore formed in the bit body at the conoidal end having a slope of greater than 110° , wherein each nozzle bore comprises a radiused transition between the bit body surface of a junk slot and an inner surface of the nozzle bore, each nozzle bore further comprising an intersecting surface between the bit body surface of a junk slot of the at least one junk slot and an inner surface of the nozzle bore, the radiused transition defining at least one sidewall extending tangentially from the intersecting surface.

25. The drill bit of claim 24, wherein the conoidal end has a slope of greater than 120° when measured with respect to the longitudinal axis.

26. The drill bit of claim 24, further comprising a nozzle disposed in each nozzle bore, wherein the nozzle comprises a nozzle face exposed within the nozzle bore.

27. The drill bit of claim 24, wherein the bit body comprises steel or matrix material.

28. The drill bit of claim 24, wherein the radiused transition defines at least two sidewalls of a formation evacuation channel, the at least two sidewalls extending tangentially from the intersecting surface.

29. The drill bit of claim 26, wherein the intersecting surface extends downwardly of the nozzle face and transitions into the bit body surface.

* * * * *